United States Patent [19]

Akashi et al.

[11] 4,425,684

[45] Jan. 17, 1984

[54] SEPARABLE SLIDE FASTENER

[75] Inventors: Shunji Akashi, Kurobe; Yoshio Matsuda, Nyuzen, both of Japan

[73] Assignee: Yoshida Kogyo K. K., Tokyo, Japan

[21] Appl. No.: 311,430

[22] Filed: Oct. 14, 1981

[30] Foreign Application Priority Data

Oct. 15, 1980 [JP] Japan ..... 55-146596

[51] Int. Cl.[3] ..... A44B 19/24

[52] U.S. Cl. ..... 24/434

[58] Field of Search ..... 24/205.11 R, 205.11 L, 24/205.11 F, 205.16 R, 205.16 C, 205.13 C; 66/193

[56] References Cited

U.S. PATENT DOCUMENTS

| | | | |
|---|---|---|---|
| 3,507,013 | 4/1970 | Inazawa | 24/205.16 C |
| 3,919,744 | 11/1975 | Kandou | 24/205.16 C |
| 3,962,756 | 6/1976 | Ebata | 24/205.16 C |
| 4,182,007 | 1/1980 | Yoshida et al. | 24/205.16 C |
| 4,319,387 | 3/1982 | Yoshida | 24/205.16 C |

FOREIGN PATENT DOCUMENTS

| | | | |
|---|---|---|---|
| 51-135709 | 7/1976 | Japan | 24/205.16 R |
| 52-24161 | 6/1977 | Japan | 24/205.16 R |

*Primary Examiner*—Paul J. Hirsch

*Attorney, Agent, or Firm*—Hill, Van Santen, Steadman & Simpson

[57] ABSTRACT

A separable slide fastener comprises a pair of warp-knit stringer tapes each having a pair of webs with a wale-free region therebetween, which are interconnected by a connector thread extending across the wale-free region at longitudinal intervals, the wale-free region being receptive of a chain of thread loops for attaching the stringer tape to a fabric. A pair of rows of coupling elements is mounted on opposite longitudinal edges of the stringer tapes and taken into and out of interdigitating engagement by a slider movable along the rows of coupling elements. The stringer tapes have at one end thereof a separable bottom end stop. A reinforcement member is mounted on each of the stringer tapes at the one end thereof and connected to the separable bottom end stop. The reinforcement member extends between the tape webs across the wale-free region and includes a body having a recess for receiving therein an end of the chain of thread loops on the reinforcement member against displacement thereoff.

1 Claim, 4 Drawing Figures

SEPARABLE SLIDE FASTENER

BACKGROUND OF THE INVENTION

1. Field of the Invention

The present invention relates to a separable slide fastener for use on knit garments such as cardigan sweaters.

2. Prior Art

There have been proposed separable slide fasteners which have in their stringer tapes longitudinal coarse regions or openings loosely receptive of a chain of thread loops for attaching the stringer tape to a knit garment, and which include a separable bottom end stop mounted on a lower end of the stringer tape. Such separable slide fasteners are described in copending U.S. patent applications Ser. Nos. 223,201 and 258,647 filed Jan. 7, 1981 and April 29, 1981, respectively, which have been assigned to the present assignee. The proposed separable slide fasteners are connected to knit garments on a knitting machine or linking machine with needles of the machine insertable into the openings in the stringer tape. The separable slide fastener as attached to the knit garmet is prevented from becoming puckered or wavy since the openings in the tape that loosely accommodate the thread loops take up forces applied to the knit garment. The knit garment such as a cardigan sweater, while worn with the slide fastener closed, is subjected to a lateral pull particularly at its hem or lower end around the wearer's waist, imposing more tension on a lower end of the slide fastener than on other parts of the latter. Therefore, an end of the chain of thread loops which extends around the lower end of the slide fastener is likely to be displaced laterally off the tape end under continued or sudden lateral stresses.

SUMMARY OF THE INVENTION

A separable slide fastener according to the present invention includes a reinforcement member mounted on each of the stringer tapes at a lower end thereof and connected to a separable bottom end stop attached to the end of the stringer tapes, the reinforcement member extending transversely of the stringer tape across a wale-free coarse region between laterally spaced webs of the stringer tape. The reinforcement member includes a thick body injection-molded around the lower end of the stringer tape and having a bottom facing away from the stringer tape, there being a recess defined in the bottom of the reinforcement body and opening away from the stringer tape in substantial alignment with the wale-free coarse region. When the slide fastener is mounted on a knit fabric by chains of thread loops, a lowermost one of the thread loops extends around each reinforcement body and is received in the recess stably against displacement off the reinforcement body.

It is an object of the present invention to provide a separable slide fastener attachable to a knit garment and having means for anchoring a thread loop stably on a separable bottom end stop on a lower end of the slide fastener against displacement under forces applied to the knit garment to which the slide fastener is attached.

Many other advantages and features of the present invention will become manifest to those versed in the art upon making reference to the detailed description and the accompanying drawings in which a preferred structural embodiment incorporating the principles of the present invention is shown by way of illustrative example.

DETAILED DESCRIPTION

Figure 1:
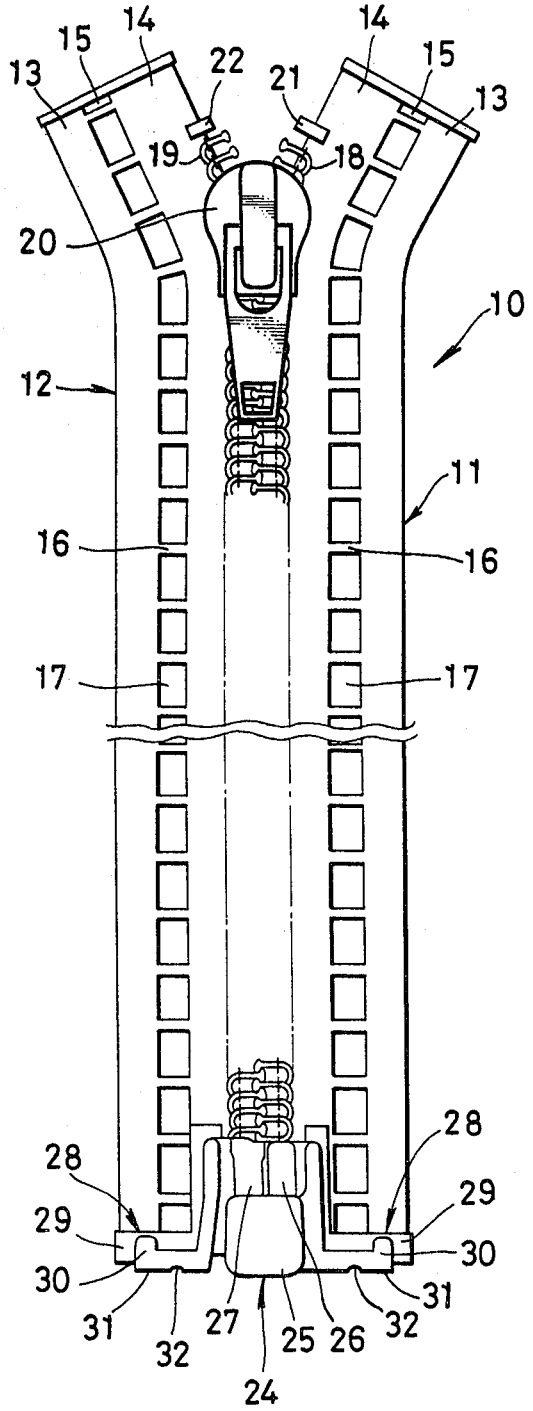
FIG. 1 is a plan view of a separable slide fastener according to the present invention.

As shown in FIG. 1, a separable slide fastener 10, for use on a garment such as a cardigan sweater having completely separble opposite edges along which the fastener is attachable, comprises a pair of warp-knit stringer tapes 11, 12 each including a pair of first and second longitudinal warp-knit webs 13, 14 with a wale-free coarse region 15 therebetween which is preferably devoid of one to four wales. The webs 13, 14 are interconnected by a connector thread 16 extending transversely across the wale-free region 15 at longitudinal intervals, providing a plurality of rectangular openings 17 arranged longitudinally in and along the wale-free region 15. A pair of rows of coupling elements 18, 19 which are made preferably of filamentary plastic material is mounted respectively on the second webs 14, 14 along longitudinal opposite edges thereof. A slider 20 is slidably mounted on the rows of coupling elements 18, 19 for taking the latter into and out of interdigitating engagement to open and close the slide fastener 10.

A pair of top end stops 21, 22 is secured respectively to the opposed edges of the webs 14, 14 and located at upper ends of the stringer tapes 11, 12 to prevent the slider 20 from moving off the rows of coupling elements 18, 19 past the top end stops 21, 22. A separable bottom end stop 24 is moounted on lower ends of the stringer tapes 11, 12 and includes a box 25 and a box pin 26 extending therefrom, the box 25 and the box pin 26 being injection-molded on the lower end of the stringer tape 11, and a pin 27 injection-molded on the end of the stringer tape 12 and insertable into and removable from the box 25 in parallel relation to the box pin 26. The separable bottom end stop 24 is located at a lower end of the rows of coupling elements 18, 19.

Figure 2:
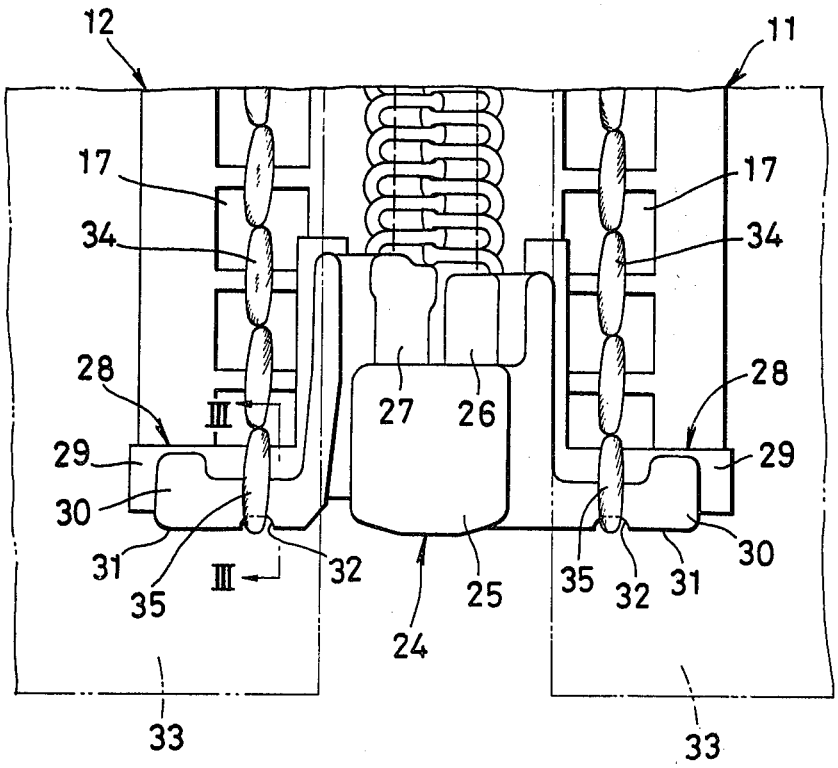
FIG. 2 is an enlarged fragmentary plan view of the separable slide fastener of FIG. 1 as mounted on a knit fabric.
Figure 3:
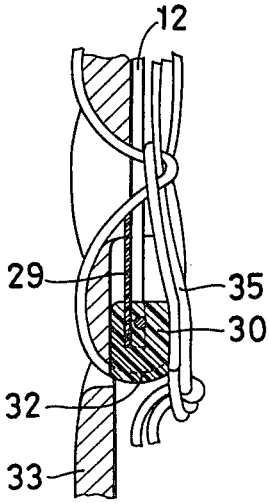
FIG. 3 is an enlarged cross-sectional view taken along line III—III of FIG. 2.

As best illustrated in FIGS. 2 and 3, a pair of reinforcement members 28, 28 of thermoplastic synthetic resin is mounted on the lower ends of the stringer tapes 11, 12, respectively and connected to the separable bottom end stop 24. Each of the reinforcement members 28 includes an L-shaped thin film 29 bonded to the stringer tape and a thick body 30 injection-molded on the tape and extending transversely between the first and second webs 13, 14 across the wale-free region 15, the body 30 being disposed around the lower end of the stringer tape as best shown in FIG. 3.

The thick body 30 has in bottom 31 thereof a recess 32 substantially aligned with the wale-free region 15 and opening away from the stringer tape. When the slide fastener 10 is mounted on a knit fabric 33 by chains of thread loops 34 running along the wale-free regions 15, a lowermost thread loop 35 extends around each reinforcement body 30 and is received in the recess 32 as best illustrated in FIG. 2. The thread loop 35 thus received in the recess 32 is stably anchored therein without the risk of being displaced off the reinforcement body 30 under forces imposed on the knit fabric 33 which tend to pull the slide fastener stringer tapes 11, 12 laterally apart.

Figure 4:
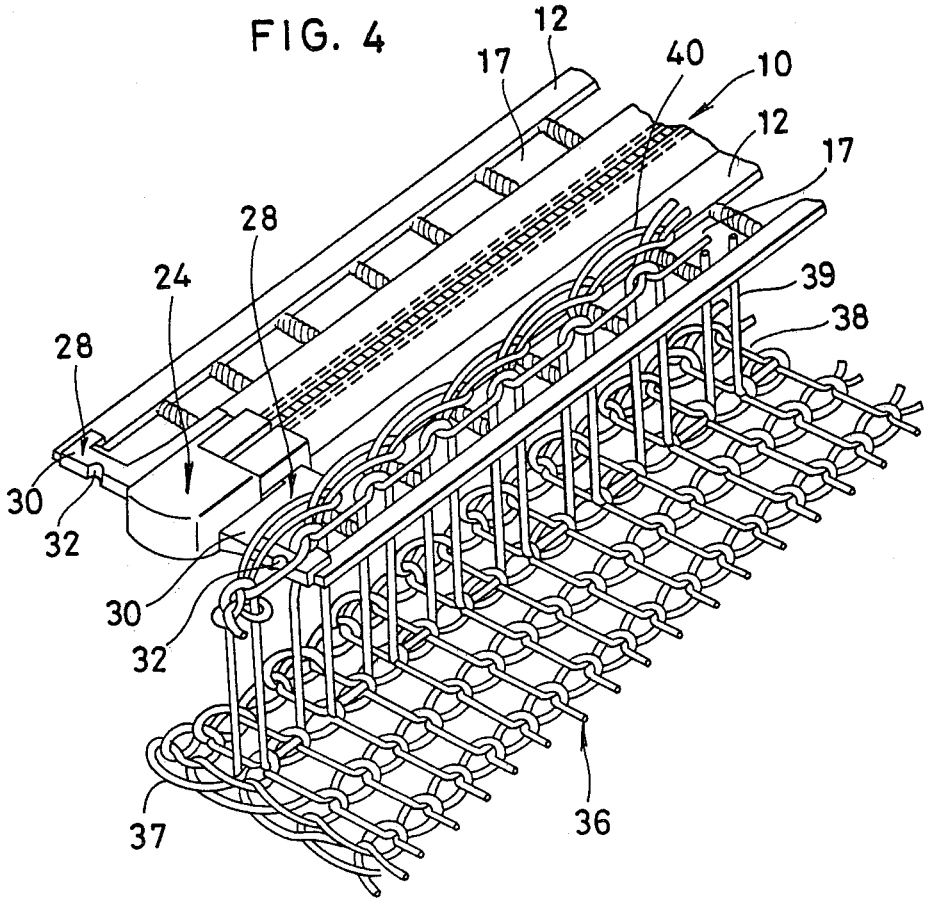
FIG. 4 is an enlarged fragmentary perspective view of the separable slide fastener shown in FIG. 1 as attached to a knit fabric with thread loops.

As shown in FIG. 4, the separable slide fastener 10 can attached to a knit fabric 36 along an edge 37 thereof on a knitting or linking machine having knitting needles or points (not shown) inserted through the knit fabric 36 along a course 38 and the openings 17 in the stringer tapes. When the machine operates, needle loops 39 are looped around the needles and then interlooped with a chain of thread loops 40, thus forming a double chain stitch which connects the slide fastener 10 to the knit fabric 36.

Although various minor modifications might be suggested by those in the art, it should be understood that we wish to embody within the scope of the patent warranted hereon, all such embodiments are reasonably and properly come within the scope of our contribution to the art.

We claim as our invention:

1. A separable slide fastener comprising:

(a) a pair of warp-knit stringer tapes each including a pair of first and second webs with a wale-free region extending longitudinally therebetween, and a connector thread interconnecting said first and second webs transversely across said wale-free region at longitudinal intervals, said stringer tapes being juxtaposed with said second webs disposed adjacent to each other, said wale-free region being receptive of a chain of thread loops for connecting said stringer tape to a fabric;

(b) a pair of rows of coupling elements each mounted on said second web of one of said stringer tapes remotely from said wale-free region;

(c) a slider movable along said pair of rows of coupling elements for engaging and disengaging the latter;

(d) a separable bottom end stop comprising a box and a box pin extending therefrom, which are mounted on one of said stringer tapes at one end thereof, and a pin mounted on the other stringer tape at one end thereof and insertable into said box; and (e) a reinforcement member mounted on each of said stringer tapes at said one end thereof and connected to said separable bottom end stop and extending between said first and second webs across said wale-free region, said reinforcement member including a body disposed around said one end of the stringer tape and extending transversely of said stringer tape, said body having a recess opening away from said stringer tape for receiving therein an end of the chain of thread loops.

* * * * *